US007808429B2

(12) United States Patent
Curry et al.

(10) Patent No.: US 7,808,429 B2
(45) Date of Patent: Oct. 5, 2010

(54) BEAM STEERING CONTROL FOR MOBILE ANTENNAS

(75) Inventors: Mark A. Curry, Lynnwood, WA (US); Frank R. Brogden, Auburn, WA (US); Fong Shi, Bellevue, WA (US); Mark R. Davis, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 733 days.

(21) Appl. No.: 11/643,213

(22) Filed: Dec. 21, 2006

(65) Prior Publication Data

US 2008/0150798 A1 Jun. 26, 2008

(51) Int. Cl.
*H01Q 3/00* (2006.01)

(52) U.S. Cl. ..... 342/359; 342/368; 342/372; 343/757

(58) Field of Classification Search ..... 342/359, 342/372, 368; 343/757
See application file for complete search history.

(56) References Cited

U.S. PATENT DOCUMENTS 4,589,610 A * 5/1986 Schmidt ..... 244/3.19
5,166,693 A * 11/1992 Nishikawa et al. ..... 342/422
6,122,595 A * 9/2000 Varley et al. ..... 701/220
2004/0036650 A1 * 2/2004 Morgan ..... 342/357.14
2007/0118286 A1 * 5/2007 Wang et al. ..... 701/213

FOREIGN PATENT DOCUMENTS

EP 1231668 8/2002

OTHER PUBLICATIONS

UK Search and Examination Report dated Apr. 14, 2008.
Micromachined Angular Rate Sensor, QRS11, Systron Donner Inertial (www.systron.com), pp. 1-2.
GyroChip II Manual, MEMS Angular Rate Sensor Model QRS14, BEI Systron Donner Inertial Divisional (www.systron.com), pp. 1-8.

* cited by examiner

*Primary Examiner*—Jack Keith
*Assistant Examiner*—Rami Khatib
(74) *Attorney, Agent, or Firm*—Gates & Cooper LLP

(57) ABSTRACT

A method and apparatus for steering a beam from a phased array antenna mounted on a mobile platform. Rate sensors mounted on the phased array antenna are used to update lower bandwidth data from the mobile platform, resulting in improved pointing performance.

18 Claims, 7 Drawing Sheets

402

```
% Predict
  % Run state forward to present time
  x(1) = x(1) + dt* (y_gyro(n-1) - x(3));
  x(2) = y_gyro(n-1) - x(3);
  x(3) = x(3);

  % and Cov forward
  P = A*P*A' + W*Q*W';
```

404

```
% Correct
if mod((n*dt)/dT,1)==0                  % INS update at dT rate
    V = eye(2);
    % Measurement Jacobian
    H = [ 0 1 1; 1 0 0];                % sample angle and gyro
    R = [ .1^2 0; 0 .001^2];
    z = [ y_gyro(n-1); y_accel(n-1)];   % biased gyro and INS angle
else
    V = 1;
    % Measurement Jacobian              % sample gyro only
    H = [ 0 1 1];
    R = [ .1^2];
    z = y_gyro(n-1);                    % biased gyro measurement
end

% using measurements at present time
K = P*H'*inv(H*P*H' + V*R*V');          % Kalman Gain

x = x + K*(z - H*x);                    % H linear combination of states

P = (I - K*H)*P;
out(:,n) = x;   % save the state vector
```

406

408

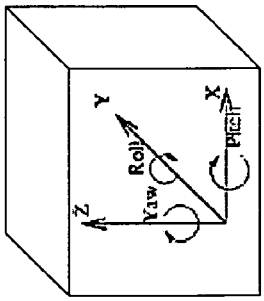

FIG. 4

BEAM STEERING CONTROL FOR MOBILE ANTENNAS

BACKGROUND OF THE INVENTION

1. Field of the Invention

The present invention relates to systems and methods for signal transmission and reception, and in particular to a system and method for steering a phased array antenna beam in moving vehicles.

2. Description of the Related Art

Phased array antennas (PAAs) are used in a variety of fixed and mobile applications including spacecraft, aircraft, naval vessels, and terrestrial vehicles. One of the advantages of PAAs is that they permit electronic beam steering, which is typically more reliable and permits faster slew rates than mechanically steered antennas. To steer the beam, PAAs typically include an Electronic Beam Steering Control (BSC) unit, located within the aperture enclosure, to accept antenna beam steering commands from a central host, to calculate the phase shift values required to steer the antenna according to the commands, and to load this phase shift values into each element/phase shifter.

Many mobile platforms include communication systems that are equipped with multiple PAAs, mounted on multiple surfaces or faces of the platform. These faces can often move independently, due to flexure in the vehicle body, masts or other structures to which the PAA is mounted. This can result in significant challenges to the tracking algorithm employed by the host to generate the antenna beam steering commands. Such challenges include substantially increased throughput, because the host must generate and provide correction to multiple pointing vectors, while responding to the independent dynamics of the multiple PAA/faces, which can include high frequency vibration and oscillation modes.

The ability for Phased Array Antenna (PAA) systems installed on mobile platforms to accurately acquire, track and communicate with moving targets must often be performed in the absence of any recognizable radio frequency (RF) power detection or demodulated Receive Signal Strength Indicator (RSSI) feedback. Thus, open loop pointing must be used to keep the beam on target.

Conventional system design relies solely on centralized Inertial Navigation Systems (INS) for open loop beam pointing. An initial pointing vector is determined through knowledge of the target's general location or through a search/acquire algorithm. The beam is then kept somewhat on-target, within the capabilities of the system, using the INS to keep track of the changes to the platform attitude. The acquisition and tracking is typically performed in some centralized (host) controller, which then passes the corrected pointing vector to the PAA.

The on-board INS is highly accurate but provides updates at a relatively slow rate . . . in most cases below 100 Hz. While this is generally acceptable for large aircraft in non-turbulent flight (when vehicle's motion is much less than 20°/sec), and interpolation can be used to derive data in-between updates, this is not the case when the platform is moving at higher rates. In some applications, it is not uncommon to experience angular rates of 300°/sec or more. Since the update rate is approximately 100 Hz, data latency alone will cause angular errors of three degrees. Further exacerbating the problem, secured communication in mobile network operations requires highly directional PAA systems, which increase pointing accuracy requirements in the order of one degree or better. Fast moving vehicles maneuvering in trenched terrain may also encounter unexpected maneuvers.

Even if INS systems on the host platform were of sufficient bandwidth, they would still be incapable of providing the data required to accurately direct the PAA beam. That is because PAA antennas may also be mounted on appendages that flex with respect to host vehicle (e.g. a PAA mounted on a tall mast of a ship at sea).

In any of the foregoing situations (high angular rate motions of the host platform, movement of the PAA relative to the host platform, or flexure of the PAA itself), can cause mobile communication to be interrupted.

There is a need to provide a beam pointing system that ameliorates the foregoing difficulties. The present invention satisfies this need.

SUMMARY OF THE INVENTION

To address the requirements described above, the present invention discloses a method and apparatus for steering a beam from a phased array antenna mounted on a mobile platform. In one embodiment, the method comprises the steps of measuring an inertial angular rate of the phased array antenna at a first data rate with at least one antenna angular rate sensor rigidly mounted on the phased array antenna, generating an estimate of an inertial angular attitude of the mobile platform at a second data rate lower than the first data rate using one or more mobile platform angular rate sensors mounted in the mobile platform and remote from the phased array antenna, generating a predictive estimate of the inertial angular attitude of the phased array antenna using the measured inertial angular rate of the phased array antenna and the estimate of the angular attitude of the mobile platform, and steering the beam using the predictive estimate of the inertial angular rate of the phased array antenna.

In a related embodiment, the apparatus is embodied in a phased array antenna motion compensation system which has at least one antenna angular rate sensor rigidly coupled to the phased array antenna, the antenna angular rate sensor having a sensitive axis aligned to measure an inertial angular rate of the phased array antenna at a first data rate, an inertial navigation system disposed in the mobile platform and remote from the phased array antenna and a beam steering controller. The inertial navigation system comprises one or more mobile platform angular rate sensors and a navigation processor for generating an estimate of an inertial angular attitude of the mobile platform at a second data rate lower than the first data rate, while the beam steering controller includes a controller processor for generating a predictive estimate of the inertial angular attitude of the phased array antenna using the measured inertial angular rate of the phased array antenna and the estimate of the angular attitude of the mobile platform and for steering the beam using the predictive estimate of the inertial angular attitude of the phased array antenna

BRIEF DESCRIPTION OF THE DRAWINGS

Referring now to the drawings in which like reference numbers represent corresponding parts throughout:

FIG. 4 is a diagram illustrating an exemplary Kalman filter design for the improved phased array antenna beam pointing system;

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Figure 1:
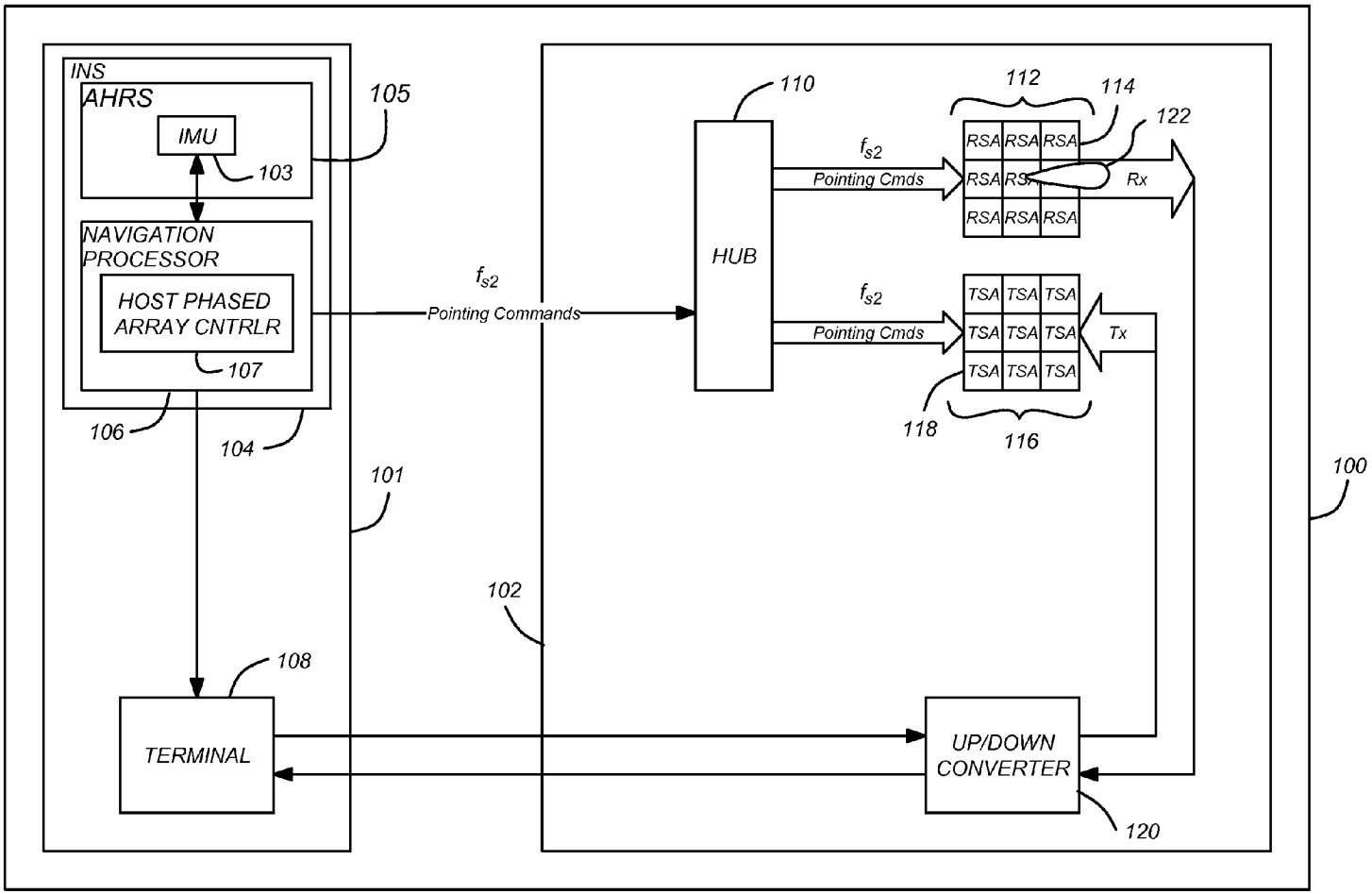
FIG. 1 Prior Art
FIG. 1 is a block diagram showing a prior art phased array beam pointing system.

FIG. 1 is a diagram an exemplary of a prior art phased array beam pointing system 100. The system comprises a platform 101 communicatively coupled to one or more phased array antenna systems (PAASs) 102 (a single PAAS 102 is illustrated). The PAAS 102 may be rigidly coupled to the platform 101 or may be flexibly or rotatably coupled to the platform 101 so as to permit PAAS 102 motion independent of the platform 101. The platform 101 is typically a mobile platform such as moving vehicle of some sort, including a spacecraft or satellite, aircraft, naval vessel, or terrestrial vehicle.

The platform 101 comprises an attitude and heading reference system (AHRS) 105 which provides attitude and heading information. Typically, the AHRS 105 includes a plurality of inertial sensors, typically packaged in an inertial measurement unit (IMU 103), and may also include devices such as a GPS receiver and/or magnetometer. The inertial sensors typically include one or more (typically three) mobile platform angular rate sensors such as rate gyros, configured to measure the angular rotation rate of the vehicle in three independent directions (usually pitch, roll, and yaw) and three accelerometers, configured to measure the acceleration of the vehicle in three independent directions. These measurements are provided to a communicatively coupled navigation processor 106 where the sensor data is processed to generate an estimate of the inertial angular attitude of the vehicle. The navigation processor 106 may also generate an estimate of the position of the vehicle using the sensor data as well. Using these estimates and the position of the target at which it is desired to point the PAA antenna beam(s) 122, the host phased array antenna controller 107 computes pointing commands and provides them to the PAAS 102. This may occur through a hub 110. The pointing commands are provided to a receiver phased array antenna 112. The receiver phased array antenna comprises a plurality of multiple element (in the illustrated embodiment 1024 element) subarrays (RSAs) 114. The pointing commands are used to generate the desired phase setting for each of the elements in each of the subarrays 114 in order that the resulting beam 122 is directed in the desired direction.

Communication signals received by the receive PAA 112 are provided to converter 120 and thence to the terminal 108. Communications to be transmitted by the transmit PAA 116 are provided from the terminal 108 to the transmit PAA 116 via the converter 120 as well.

Pointing commands are also provided to a transmitter phased array antenna 116 which comprises a plurality of multiple element subarrays (TSAs) 118. As was the case with the receive PAA 112, the pointing commands are translated to phase settings that collectively result in directing a beam of the transmit PAA 116 in the desired direction. Communication signals to be transmitted by the transmit PAA 116 are provided by the terminal 108 to the converter 120 and thence to the transmit array 116.

As described above, the prior art PAAS 100 shown in FIG. 1 has serious deficiencies that limit its usefulness in mobile applications, particularly where the platform 101 may experience high angular rates, or PAA 102 is not rigidly mounted to the platform 101, but rather, mounted on a flexible structure such as a mast. This is because the update rate $f_{s2}$ of the data from the inertial navigation system (INS) 104 is insufficient to provide sufficient estimates between those updates, and because the data itself is inaccurate in that it may reflects the inertial angular attitude of the platform 101, but due to flexure of the mounting between the platform 101 and the PAAs 112, 116 it may not represent the actual position of the PAAs 112, 116.

Figure 2:
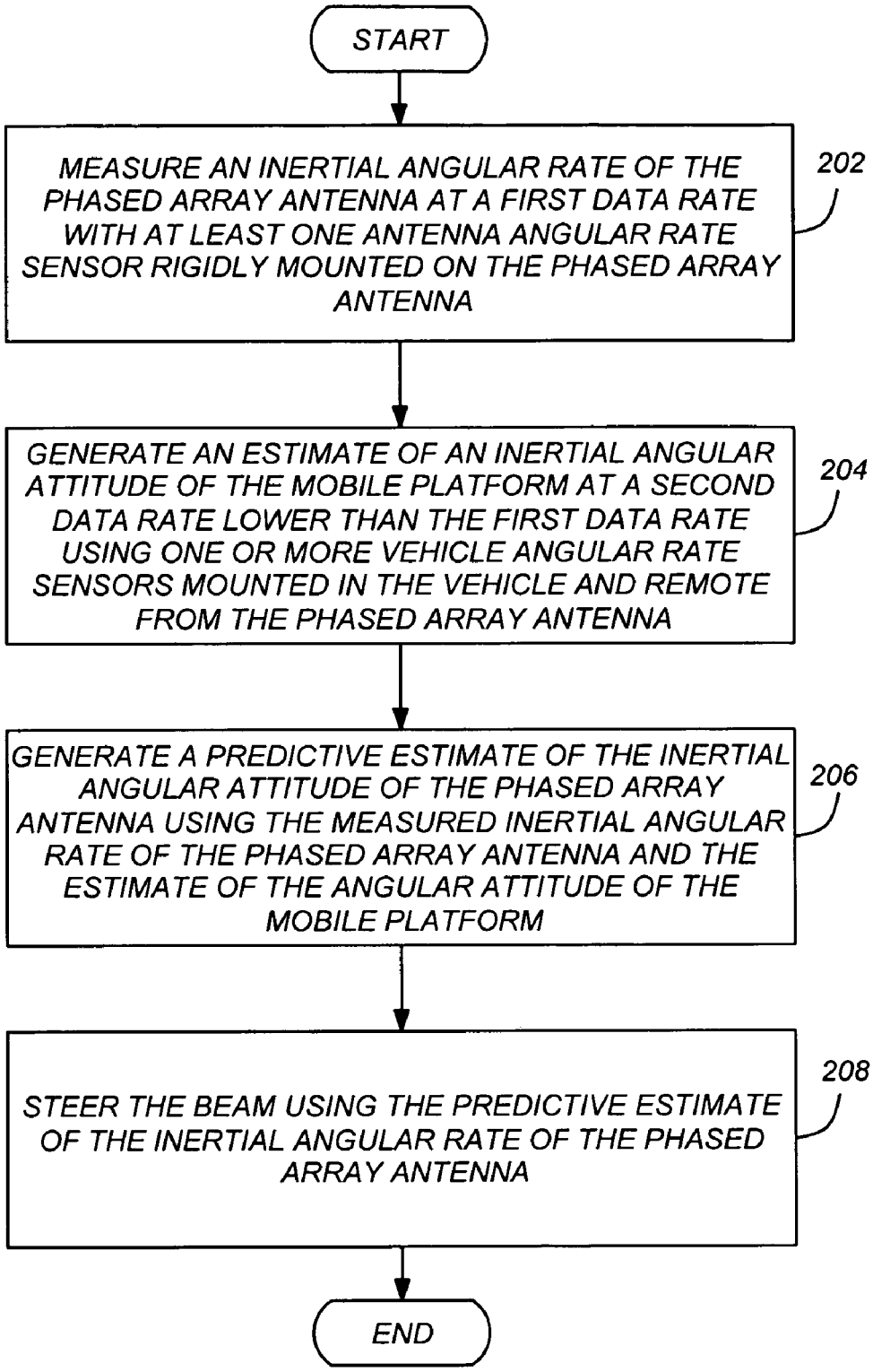
FIG. 2 is a flow chart presenting an illustrative example of process steps used in an improved phased array beam pointing system.

FIG. 2 is a diagram presenting exemplary steps that can be used to accurately and quickly direct the beam of either PAA 112, 116 to a desired location, while overcoming the foregoing limitations. For purposes of illustration, the described process will refer to receive PAA 112, however, the same process can be used to direct the beam of the transmit PAA 116 or both PAAs 112, 116. Also, FIG. 2 will be discussed in concert with FIG. 3, which is a diagram illustrating an improved PAAS 300.

An inertial angular rate of the PAA 112 is measured, as shown in block 202. In the embodiment illustrated in FIG. 3, the inertial angular rate of the PAA 112 is measured by a beam steering control system (BSCS) 302 using one or more antenna angular rate sensors 305P, 305Y and 305R (hereinafter alternatively referred to as angular rate sensor(s) 305) mounted on the PAA 112, communicatively coupled to a beam steering controller 304. The beam steering controller 304 (further discussed below) includes a controller processor 306, having access to a memory storing instructions for performing the operations described below, including the implementation of an estimator such as a Kalman Filter 308. In one embodiment, the angular rate sensor 305 is a rate gyro, however other devices may be used.

The angular rate sensor(s) 305 provide data at a first data rate ($f_{s1}$). Typically, three angular rate sensors 305 are employed, one for rotations about each of three orthogonal axes. For example, a pitch channel angular rate sensor 305P to measure PAA 112 inertial angular rates about the pitch axis, a yaw channel angular rate sensor 305Y for measuring PAA 112 inertial angular rates about the yaw axis, and a roll channel angular rate sensor 305R for measuring PAA 112 inertial angular rates about the yaw axis. These sensors may be included in a single package such as a high bandwidth 3 axis "tactical grade" gyro sensor module, available from BEI/SYSTRON DONNER INERTIAL. The signals from gyros 305P, 305R, 305Y are used to steer the receive PAA 112 and/or the transmit PAA 116 as described below, but for purposes of explanation, one channel is described.

An estimate of the inertial angular attitude of the platform 101 is then generated using one or more vehicle angular rate sensors mounted in the vehicle and remote from the PAA 112, as shown in block 204. In the illustrated embodiment, the vehicle angular rate sensors mounted in the platform 101 include one or more rate gyros, and typically, those gyros are also oriented to orthogonal axes such as the pitch and yaw axes. The angular attitude of the platform 101 can be determined by integrating the angular rate information provided by the gyros and this data may be corrected using information provided by the IMUs accelerometers or by other sensing devices.

The estimate of the inertial angular attitude of the platform 101 can take a variety of forms. In one embodiment, it is comprised of the inertial angular attitude in pitch, roll, and yaw channels. In another embodiment, it is comprised of the inertial angular attitude in the pitch and roll channels, and heading information.

The estimate of the inertial angular attitude of the platform 101 is provided at a second data rate ($f_{s2}$) that is lower than the rate of the data obtained from the angular rate sensors 305 ($f_{s1}$). Typically, $f_{s2}$ is in the order of about 100 Hz, while $f_{s1}$ can be as high as 100 KHz. For some applications, the higher bandwidth of the data available from the angular rate sensors 305 is critical because the 100 Hz data rate available from the navigation processor 106 is insufficient for beam steering purposes. This can be the case, for example, if the platform 101 is undergoing large (>20 degree per second) angular rates, or if the PAA 112 is moving relative to the platform 101 at frequencies higher than 50 Hz.

Returning to FIG. 2, a predictive estimate of the inertial angular attitude of the PAA 112 is generated using the measured inertial angular rate of the PAA 112 and the estimate of the angular attitude of the platform 101 obtained from the inertial navigation system 104, as shown in block 206. This is accomplished by the beam steering controller 304, via the processor implementing the Kalman filter 308. The predictive estimate from the Kalman filter 308 can be upsampled to a higher data rate ($f_{s3}$) if necessary, but will typically be provided at the same rate ($f_{s1}$) as the data obtained from the angular rate sensors 305.

In one embodiment, each of the subarrays 114 comprises an internal universal beam steering controller (UBSC) which accepts beam steering commands from the hub 110 and computes the phase settings for each element in the subarray 114. Each UBSC may also accept PAA 112 temperature information, calibration data, and PAA geometry information in order to compute the antenna output. The beam pointing correction for platform 101 dynamics is performed using a distributed approach (separate rotation of the last received pointing vector from the host applied in each UBSC). This topology provides fast beam steering updates, corrected for platform 101 and PAA 102 dynamics and significantly off-loads the processing requirements from the platform 101 and reduces the bandwidth requirements on the platform 101 to PAA 102 control interface. While this topology may also introduce errors over time via the cumulated bias of gyros 305P, 305Y and 305R, the bias shift is small because of the relatively short time between the updates from the host (10 ms) and is purged out by the updated data.

Figure 3:
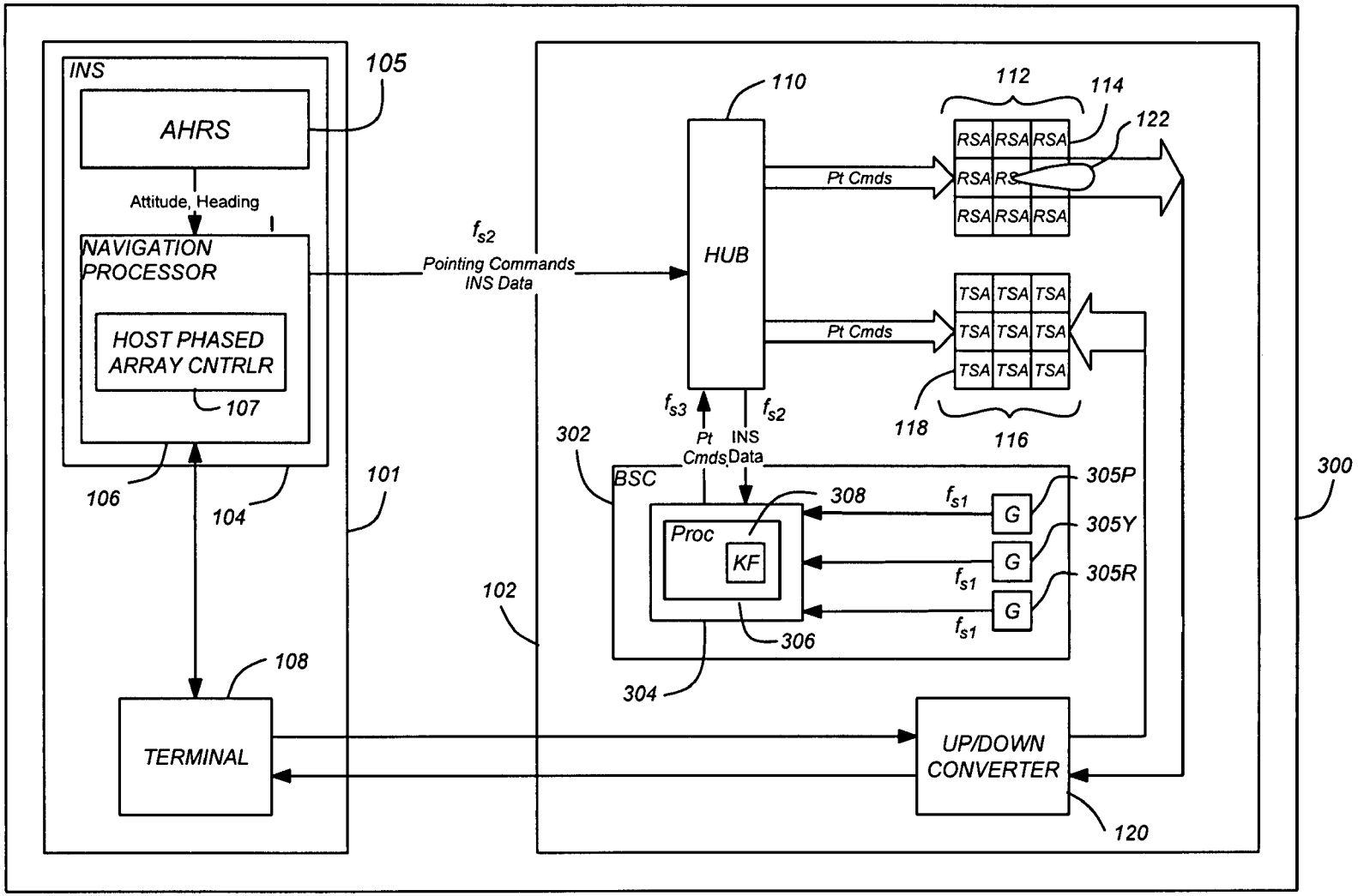
FIG. 3 is a block diagram illustrating an improved phased array antenna beam pointing system.

Finally, the beam 122 is steered using the predictive estimate of the inertial angular rate of the phased array antenna 112, as shown in block 208. As shown in FIG. 3, this can be accomplished by the BSC 302 generating angular pointing commands using the estimate of the inertial angular attitude of the platform 101 and the inertial rate of the PAA 112, 116. The angular pointing commands are transmitted to the receive array 112 and the transmit array 116 via hub 110. Note that the angular pointing values now include information at a much higher rate than possible from the INS alone, and hence, can be used to between INS updates.

FIG. 4 is a diagram illustrating key elements of an exemplary Kalman filter 308. This exemplary filter 308 is presented for explanatory purposes alone, and hence, is limited to a single channel, and cross coupling factors, coordinate transformations and other secondary effects are not shown. Such factors can be accounted for by use of Euler angles, Quaternions and the like, as well known by those of ordinary skill in the art.

This exemplary Kalman Filter defines states as the PAA 112 inertial angle, angle rate, and gyro bias in each of the three axes (pitch, roll, and roll). The time update section 402 generates a prediction for the angle, angle rate, and gyro bias states every high data rate $$\left(f_{s1} \text{ or } \frac{1}{dt}\right),$$

to run the state and covariance matrices to the present time. The correction section 404 includes an section 406 which is update using the data from the INS 104 at $f_{s2}$ $$\left(\frac{1}{dT}\right),$$

and a section 408 that updates the data using the gyro 305 data at $f_{s1}$. The angle data x(1) for each of the axes represents the predictive estimate of the inertial angular attitude of the PAA 112. The "y_accel(n−1)" factor represents the use of accelerometer data that is used to reduce the effect of gyro drift.

Note that since the Kalman filter 308 arrives at the angle estimates essentially by integrating the data received from the rates sensors 305, any noise or bias in the signal provided by the rate sensors 305 will result in an increasingly inaccurate estimate of the PAA 112 inertial angle. An improved estimate can be obtained if inertial angular attitude data is available from another sensor by periodically updating the predicted angle x(1) according to the following relationship:

$$x(1)=x(1)+dt*G*(\theta_{est}-y_gyro(n-1))$$

wherein G is a time-varying gain derived in the Kalman filer equations and $\theta_{est}$ is an estimate of the PAA 112 inertial angle from another sensor. $\theta_{est}$ may be obtained from the estimate of the inertial angular attitude of the platform 101 from the INS 104, from one or more accelerometers mounted on the PAA 112, or from other sensors. Added accelerometers or magnetometers can be used to provide an estimate of how the PAAs are tilted. Such angles can be passed to the beam steering controller directly without being integrated with the gyro values.

Figure 5:
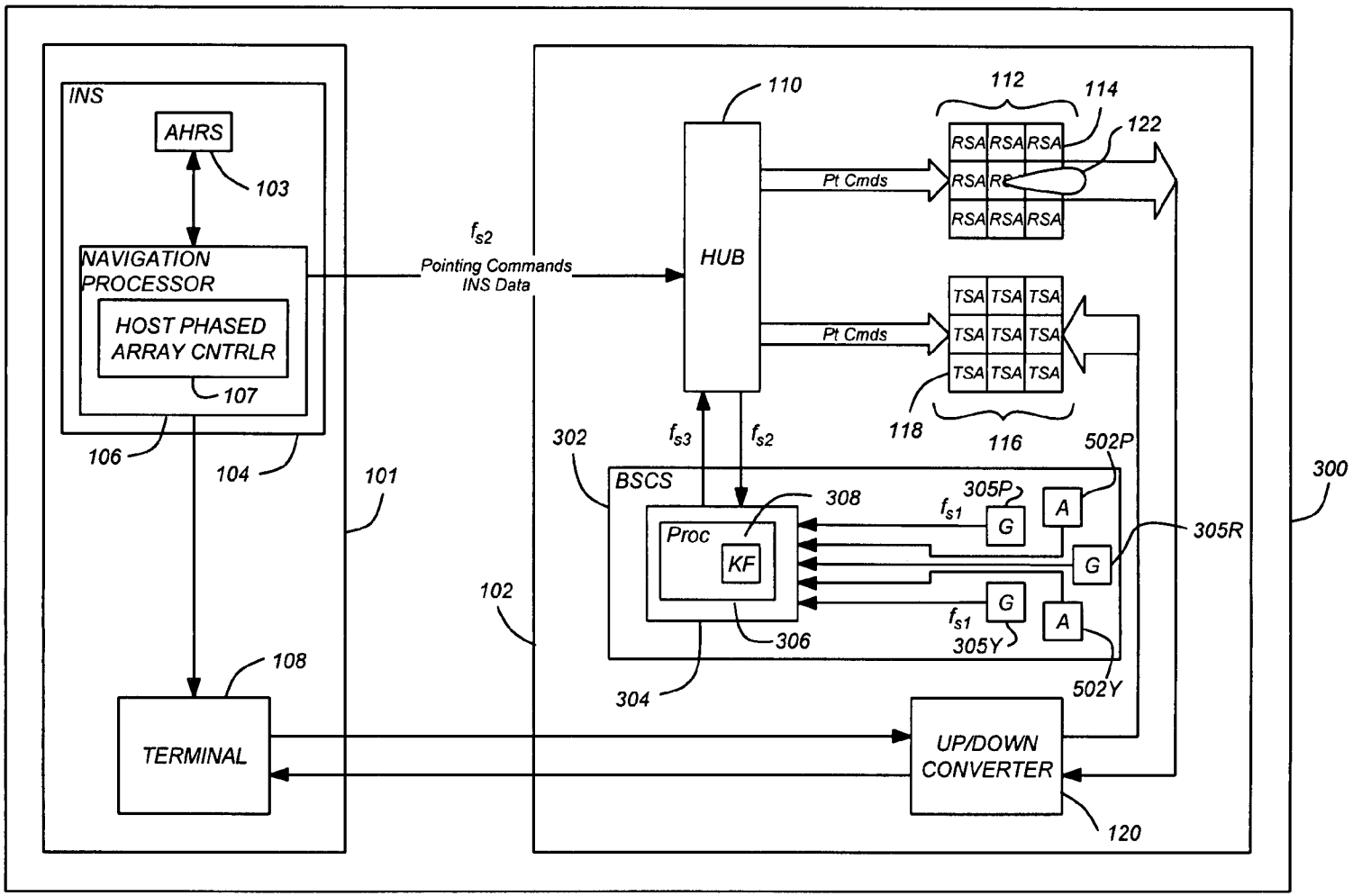
FIG. 5 is a diagram illustrating embodiment of an improved phased array antenna beam pointing system using additional data to improve pointing command accuracy.

FIG. 5 is a diagram illustrating another embodiment of the improved PAAS 300. In this embodiment, the BSCS (302) further comprises one or more accelerometers 502. The data from these accelerometer(s) 502 is used to provide additional data that can be used to improve the pointing commands for the PAAs 112, 116. This configuration is useful in circumstances where the PAA 112 may be mounted to the platform 101 in a way such that the attitude or position of the PAA 112 may become offset from the nominal position. For example, the PAA 112 may be mounted on the wing of an aircraft. When the aircraft is on the ground and the wing is not loaded, the angular position of the PAA 112 will be different than when the airplane is in flight and the wing is loaded. From a perspective of the geometry between the platform 101 and the target, this difference itself does not generally result in large pointing errors, but may negatively affect the measurement accuracy the rate sensors 305 on the PAA 112. To compensate for these errors, the lateral acceleration of the PAAs 112, 116 available from the accelerometers 402 is provided to the BSC 306.

This data is used to estimate the inertial attitude of the PAAs 112, 116 and this information is used to generate an improved predicted estimate of the inertial angular attitude of the phased array antenna as described above.

Figure 6:
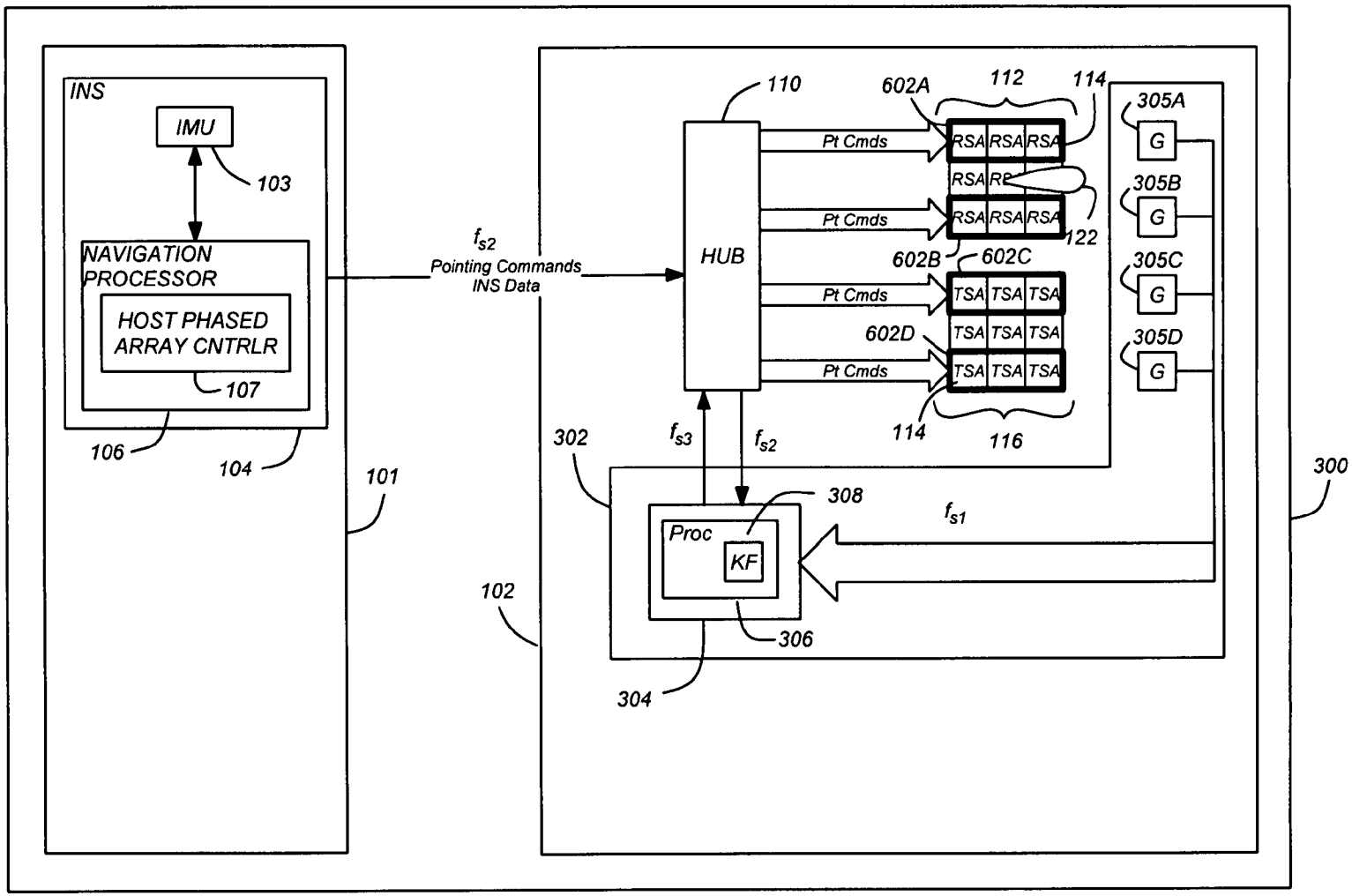
FIG. 6 is a diagram of an improved phased array antenna beam pointing system in which the angular attitude of portions of the phased array antenna is measured and used to direct the antenna beam.

FIG. 6 is a diagram of another embodiment of the improved PAAS 300. This embodiment is similar to the embodiments described in FIGS. 3-5, but in this embodiment, the PAAs 112, 116 are defined to include a plurality of portions 602A-602D, and rate sensor packages 305A-305D are mounted to each of the plurality of portions 602 of the PAAs 112, 116 (for the sake of simplicity, the terminal 108, converter 120, and related structures are also omitted). The inertial angular rate of each portion of the PAAs 112, 116 is measured by the sensor packages 305A-305D, and these measurements are provided to the beam steering controller 304. Using the techniques described above, the beam steering controller 304 generates a predictive estimate of the inertial angular attitude of each portion of the phased array antenna using this data (and the INS data from the INS 104, and this information is used to generate beam pointing commands for each of the portions of the PAAs 112, 116. This embodiment is especially useful for embodiments wherein the different portions of the PAA 112, 116 may be at different inertial angles. This might be the case, for example, if the PAA 112, 116 were flexible, large, or where the vibrations of the PAA 112, 116 itself created sufficiently large errors in beam pointing to warrant their measurement and compensation.

Figure 7:
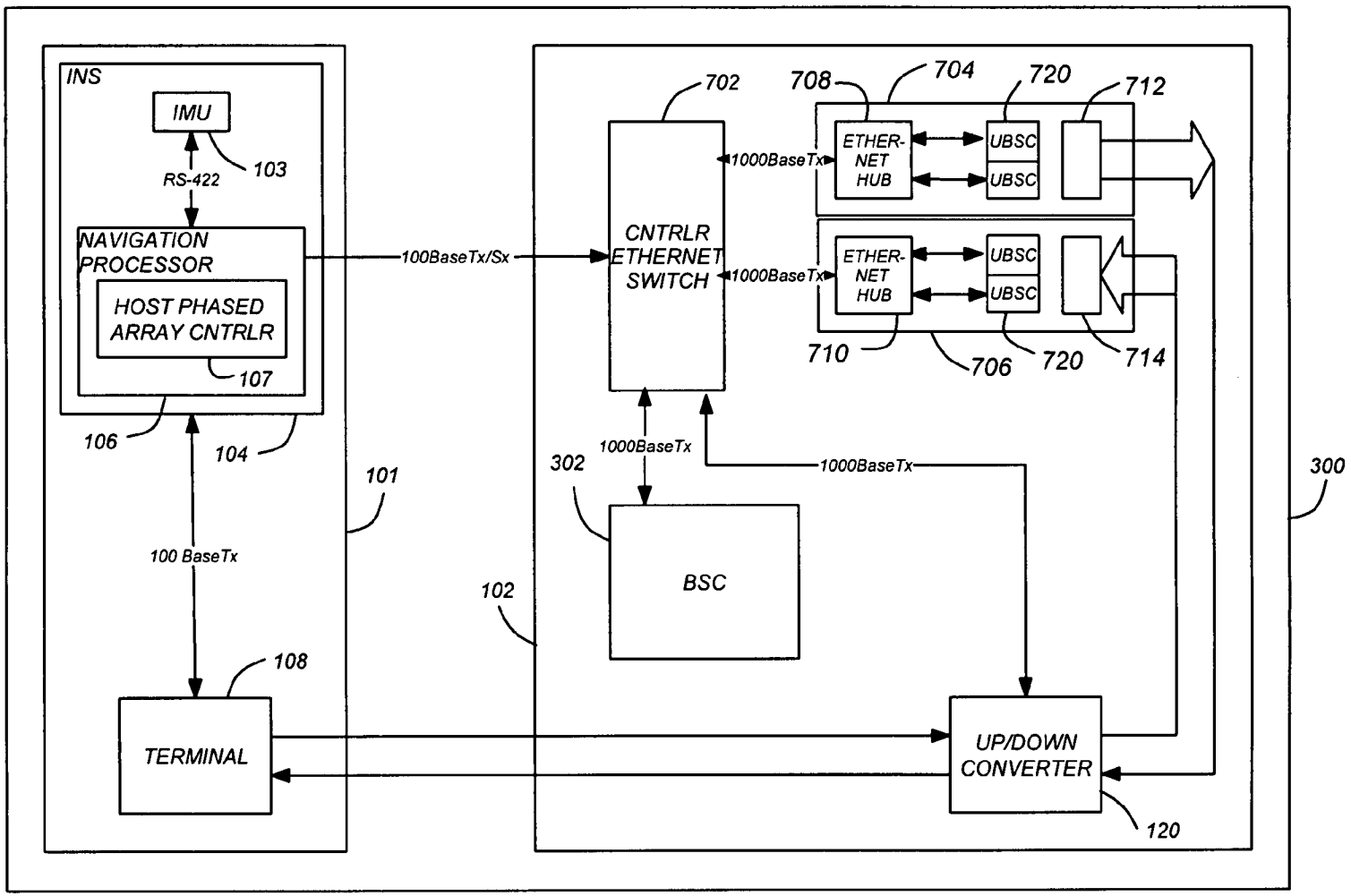
FIG. 7 is a diagram of another embodiment of the improved phased array antenna beam pointing system, using Ethernet communication protocols.

FIG. 7 is a diagram illustrating one embodiment of how the systems described in FIGS. 3-6 may be implemented. In this embodiment, key communication links are implemented using Ethernet protocols, Specifically, the PAAS 102 comprises a controller/Ethernet switch 702 in place of the hub 110, and communications between the platform 101 and the PAAS 102 are handled by the Ethernet switch 702 via a 100BaseTxSx link. Communications between the Ethernet switch 702 and the BSC 302 are via a 1000BaseTx link, as are communications between the Ethernet switch 702 and the receive PAA 704 and the transmit PAA 706 via Ethernet hubs 708, 710, which communicate with the subarrays 114. Radio frequency switch matrices 712 and 714 handle the received and transmitted RF energy.

Through a hub/gateway, each PAA 704, 706 receives the pointing commands from the host phased array controller 107 (at a reduced rate) and the higher-performance dynamic platform attitude updates (at an increased rate) from the BSC 302. The BSC 302 fuses INS and sensor data, and performs predictive filtering. A universal beam steering controller (UBSC) 720 in each subarray then performs a rotation of the last received pointing vector from the INS 104 using the lower latency, higher update rate platform attitude received from the BSC 302. The platform dynamics correction is performed using a distributed approach (separate rotation applied in each UBSC 302).

CONCLUSION

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method for steering a beam from a phased array antenna mounted on a mobile platform, comprising the steps of:

measuring an inertial angular rate of a plurality of portions of the phased array antenna at a first data rate with a plurality of antenna angular rate sensors, each of the plurality of angular rate sensors rigidly mounted to an associated one of the plurality of portions of the phased array antenna to measure the angular rate of the associated portion of the phased array antenna;

generating an estimate of an inertial angular attitude of the mobile platform at a second data rate lower than the first data rate using one or more mobile platform angular rate sensors mounted in the mobile platform and remote from the phased array antenna;

generating a predictive estimate of the inertial angular attitude of each portion of the phased array antenna using the measured inertial angular rate of each portion of the phased array antenna and the estimate of the inertial angular attitude of the mobile platform; and steering the beam using the predictive estimate of the inertial angular rate of each portion of the phased array antenna.

2. The method of claim 1, wherein the phased array antenna is rigidly mounted to the mobile platform.

3. The method of claim 1, wherein the angular attitude comprises a pitch angular attitude, a roll angular attitude and a heading.

4. The method of claim 1, wherein the pitch angular attitude is estimated from pitch angular rate sensor data, the roll angular attitude is estimated from roll angular rate sensor data, and the heading is estimated from a global positioning system and a magnetometer.

5. The method of claim 1, wherein the method further comprises the steps of:

estimating an inertial angular attitude of the phased array antenna using an accelerometer; wherein the predictive estimate of the inertial angular attitude of each portion of the phased array antenna is further generated using the estimated inertial angular attitude of the phased array antenna from the accelerometer.

6. The method of claim 1, wherein the first data rate is an order of magnitude or more higher than the second data rate.

7. An apparatus for steering a beam from a phased array antenna coupled to a mobile platform, comprising:

a phased array antenna motion compensation system, having:

a plurality of antenna angular rate sensors, each rigidly coupled to an associated one of a plurality of portions of the phased array antenna, each of the plurality of the antenna angular rate sensors having a sensitive axis aligned to measure an inertial angular rate of the associated portion of the phased array antenna at a first data rate;

an inertial navigation system disposed in the mobile platform and remote from the phased array antenna, having:

one or more mobile platform angular rate sensors;

a navigation processor for generating an estimate of an inertial angular attitude of the mobile platform at a second data rate lower than the first data rate;

a beam steering controller having:

a controller processor for generating a predictive estimate of the inertial angular attitude of each portion of the phased array antenna using the measured inertial angular rate of each portion of the phased array antenna and the estimate of the angular attitude of the mobile platform and for steering the beam using the predictive estimate of the inertial angular attitude of each portion of the phased array antenna.

8. The apparatus of claim 7, wherein the phased array antenna is flexibly mounted to the mobile platform.

9. The apparatus of claim 7, wherein the angular attitude comprises a pitch angular attitude, a roll angular attitude and a heading.

10. The apparatus of claim 9, wherein the pitch angular attitude is estimated from pitch angular rate sensor data, the roll angular attitude is estimated from roll angular rate sensor data, and the heading is estimated from a global positioning system and a magnetometer.

11. The apparatus of claim 7, wherein:

the phased array antenna motion compensation system further comprises at least one accelerometer for estimating the inertial attitude of the phased array antenna;

the controller processor further generates the predictive estimate of the inertial angular attitude of the phased array antenna using the estimated inertial attitude of the phased array antenna.

12. The apparatus of claim 7, wherein the first data rate is at least an order of magnitude higher than the second data rate.

13. An apparatus for steering a beam from a phased array antenna mounted on a mobile platform, comprising:

means for measuring an inertial angular rate of a plurality of portions of the phased array antenna at a first data rate with a plurality of antenna angular rate sensors, each of the plurality of angular rate sensors rigidly mounted to an associated one of the plurality of portions of the phased array antenna to measure the angular rate of the associated portion of the phased array antenna;

means for generating an estimate of an inertial angular attitude of the mobile platform at a second data rate lower than the first data rate using one or more mobile platform angular rate sensors mounted in the mobile platform and remote from the phased array antenna;

means for generating a predictive estimate of the inertial angular attitude of each portion of the phased array antenna using the measured inertial angular rate of each portion of the phased array antenna and the estimate of the attitude of the mobile platform; and means for steering the beam using the predictive estimate of the inertial angular rate of each portion of the phased array antenna.

14. The apparatus of claim 13, wherein the phased array antenna is rigidly mounted to the mobile platform.

15. The apparatus of claim 13, wherein the angular attitude comprises a pitch angular attitude, a roll angular attitude and a heading.

16. The apparatus of claim 13, wherein the pitch angular attitude is estimated from pitch angular rate sensor data, the roll angular attitude is estimated from roll angular rate sensor data, and the heading is estimated from a global positioning system and a magnetometer.

17. The apparatus of claim 13, wherein:

the apparatus further comprises:

means for estimating an inertial angular attitude of the phased array antenna using an accelerometer; and wherein the predictive estimate of the inertial angular attitude of each portion of the phased array antenna is further generated using the estimated inertial angular attitude of the phased array antenna from the accelerometer.

18. The apparatus of claim 13, wherein the first data rate is an order of magnitude or more higher than the second data rate.

* * * * *